United States Patent [19]

Thornton, Jr. et al.

[11] Patent Number: 4,693,671

[45] Date of Patent: Sep. 15, 1987

[54] REVERSIBLE SELF-ADJUSTING PROPELLER DEVICE

[75] Inventors: Harold C. Thornton, Jr., Oak Ridge; Clifton W. Hall, Knoxville, both of Tenn.

[73] Assignee: Tramtec Corporation, Oak Ridge, Tenn.

[21] Appl. No.: 901,891

[22] Filed: Aug. 28, 1986

[51] Int. Cl.[4] ..... B63H 3/00

[52] U.S. Cl. ..... 416/43; 416/131; 416/202

[58] Field of Search ..... 416/131, 43, 167, 166, 416/202, 203, 23

[56] References Cited

U.S. PATENT DOCUMENTS

| | | | |
|---|---|---|---|
| 24,508 | 6/1854 | Cwefnw . | |
| 333,805 | 1/1886 | Yagn . | |
| 1,022,203 | 4/1912 | Nettle . | |
| 1,461,733 | 7/1923 | Hawes | 416/202 X |
| 1,491,997 | 4/1924 | Messick . | |
| 1,556,012 | 10/1925 | Flettner | 416/23 |
| 1,777,254 | 9/1930 | Connors . | |
| 1,930,548 | 10/1933 | Barbarou . | |
| 1,980,249 | 11/1934 | Bates | 416/43 X |
| 1,986,229 | 1/1935 | Stanley . | |
| 2,020,366 | 11/1935 | MacCallum . | |
| 2,124,369 | 7/1938 | Everts . | |
| 2,192,034 | 2/1940 | Driggs . | |
| 2,215,456 | 9/1940 | Albers | 416/23 X |
| 2,222,444 | 11/1940 | Schmidt et al. . | |
| 2,308,749 | 1/1943 | Gee . | |
| 2,360,982 | 10/1944 | Sahle . | |
| 2,374,833 | 5/1945 | Rippingille | 416/202 X |
| 2,440,295 | 4/1948 | Synnestvedt | 244/138 |
| 2,440,296 | 4/1948 | Perry | 244/138 |
| 2,444,539 | 7/1948 | Sharpes . | |
| 2,453,803 | 11/1948 | McCormick | 416/23 X |
| 2,704,128 | 3/1955 | Papadakos . | |
| 3,082,826 | 3/1963 | Doman et al. . | |
| 3,138,136 | 6/1964 | Nichols . | |
| 3,145,780 | 8/1964 | Kean | 416/43 |
| 3,253,660 | 5/1966 | Maker . | |
| 3,295,610 | 1/1967 | Frias | 416/43 X |
| 3,403,735 | 10/1968 | Langhjelm et al. . | |
| 3,575,530 | 4/1971 | Hall | 416/131 |
| 4,178,127 | 12/1979 | Zahorecz | 416/131 X |
| 4,304,524 | 12/1981 | Coxon | 416/131 |

FOREIGN PATENT DOCUMENTS

| | | | |
|---|---|---|---|
| 216337 | 1/1957 | Australia | 416/23 |
| 2413199 | 10/1974 | Fed. Rep. of Germany | 416/202 |
| 2429910 | 2/1980 | France | 416/43 R |
| 264511 | 7/1927 | United Kingdom . | |
| 1414362 | 11/1975 | United Kingdom | 416/202 |
| 2145479 | 3/1985 | United Kingdom | 416/23 |

*Primary Examiner*—Everette A. Powell, Jr.
*Attorney, Agent, or Firm*—Luedeka & Neely

[57] ABSTRACT

A self-adjusting propeller device having a control blade and a thrust blade connected together in nondiametrical relation and pivotally mounted on a hub for rotation about a hub axis. In response to a change in load on the device, the control blade pivots in relation to the hub axis at generally constant pitch, and, by virtue of the manner in which the pitch and thrust blades are interconnected and disposed on the hub, the thrust blade pivots at a changing pitch so that the device applies a substantially constant torque. Structure is provided for chaning the pitch of the control blade independently of the load from a remote location during operation of the device. The selection of control blade pitch positions provides for transmission of forces in either axial direction and at selected magnitudes including a neutral or non-force-transmitting mode.

9 Claims, 17 Drawing Figures

FIG. 13
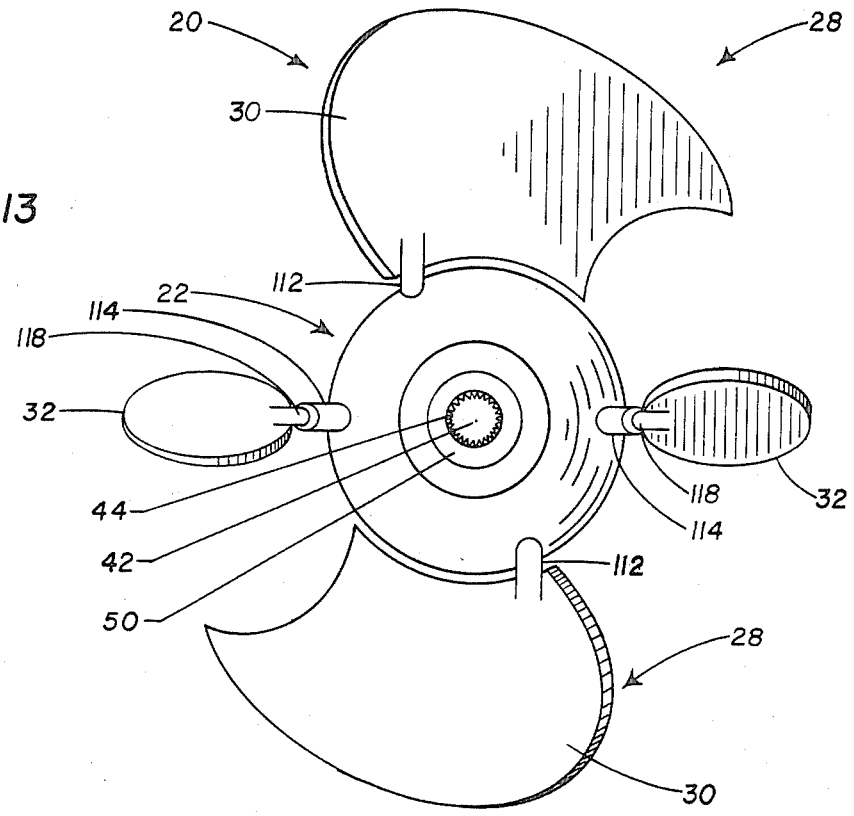
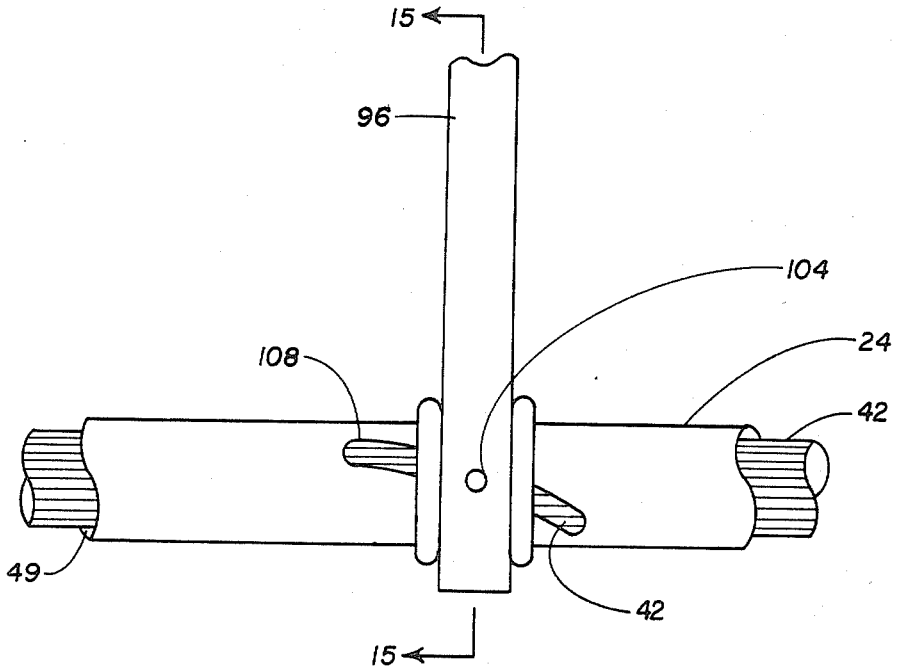
FIG. 14

REVERSIBLE SELF-ADJUSTING PROPELLER DEVICE

The present invention relates to rotating propeller devices for use in transmitting forces to and from a fluid medium and more particularly relates to a self-adjusting propeller device incorporating features that enable, during use, transmission of forces in either axial direction and in selected magnitudes, including a neutral or non-force-transmitting mode.

Propeller devices have been developed that are self-adjusting in response to changing loads so as to develop a substantially constant torque on the fluid medium. Typically, adjustment is accomplished by various internal mechanisms of the devices configured to alter the pitch of one or more blades, in relation to the axis of rotation of the device and in a dynamic manner during operation in answer to changing conditions of the fluid.

Known self-adjusting propeller devices are only capable of transmitting forces in one axial direction during use. Consequently, they are of very limited utility in applications where it is desirable or necessary to selectively transmit forces in either axial direction and at higher or lower power levels independent of the load imposed on the devices.

It is therefore an object of the present invention to provide a self-adjusting propeller device capable of selectively transmitting forces in either axial direction during use.

It is another object of the invention to provide a propeller device of the character described which is configured to transmit forces at higher or lower levels independent of the load imposed on the device.

It is a further object of the invention to provide a propeller device capable of being shifted to transmit forces in either axial direction, or at higher or lower power levels, during operation.

An additional object of the invention is the provision of a propeller device of the character described that is configured to be shifted to a neutral or substantially non-force transmitting mode during use.

Yet another object of the invention is the provision of a propeller device of the character described which transmits forces of selected magnitudes and directions independently of the load imposed on the device by means of a simple and effective mechanism controllable remotely of the device during use.

Still another object of the invention is the provision of a propeller device of the character described which is useful in a wide range of applications.

The above and other objects and advantages of the present invention will become apparent to those of ordinary skill in the art as the same becomes better understood by reference to the following detailed description when considered in conjunction with the accompanying drawings in which:

FIG. 13 is an end view of the device configured as shown in FIG. 12 illustrating the position of the blades from the end of the device toward which forces are transmitted;

FIG. 14 is a fragmentary side view of a shifting assembly configured to enable remote positioning of the pitch of the control blades through the splined shaft;

Figure 16:
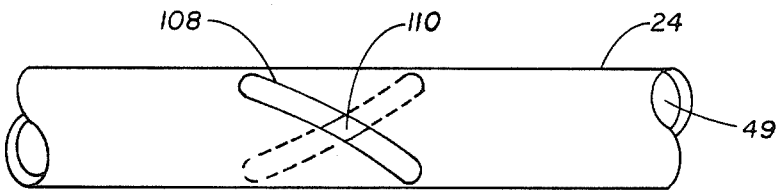
Figure 17:
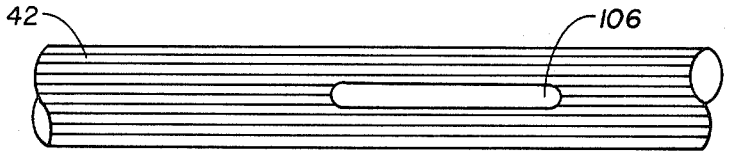

FIG. 16 is a side view illustrating spirally-directed slots formed in a drive shaft used to impart rotational movement to the hub assembly; and FIG. 17 is a side view of the elongated pinion illustrating a slot formed in the pinion for use in conjunction with the spiral slots of the drive shaft and the shifting assembly to enable angular displacement of the elongated pinion in relation to the drive shaft for shifting purposes.

Generally, the invention provides a self-adjusting propeller device for transmitting forces to and from a fluid. The device includes a thrust blade and a control blade having a smaller blade area than the thrust blade. Both blades are supported by a hub which is driven to rotate about a hub axis. Structure is provided for interconnecting the thrust and control blades so that in response to a changing load on the device, the thrust and control blades move in relation to the hub axis with the thrust blade moving in relation to the hub axis at a changing pitch with the change in pitch being proportional to the change in the load. A mechanism is further provided for changing the pitch of the control blade to selected pitch settings. Preferably, the control blade moves in relation to the hub axis while maintaining a generally constant pitch at one of the selected pitch settings and the mechanism for changing the pitch of the control blade is operable to change the pitch setting while the hub is rotating and the device is transmitting force to the fluid.

Referring now to the drawings in which like reference characters designate like or similar parts throughout the several views, a self-adjusting propeller device generally designated at 20 is shown incorporating features of the preferred embodiment of the present invention. In general, the device 20 includes a hub assembly 22 supported and rotatably driven in a fluid medium by a rotating power or drive shaft 24 connected to a first axial end 26 of the hub assembly 22. Mounted on the hub assembly 22 and symmetrically disposed about the hub axis are a pair of substantially identical thrust and control blade assemblies 28. Each of the assemblies 28 includes a thrust blade 30 and a control blade 32. The thrust blades 30 have blade areas that are substantially larger than the blade areas of the control blades 32. As will be described, the manner in which the thrust and control blades 30 and 32 are interconnected and disposed in relation to one another and the hub assembly 22 provides that in response to a changing load on the device 20, the control blades 32 pivot in relation to the hub axis at a generally constant pitch. Simultaneously with movement of the control blades 32, the thrust blades 30 pivot at a changing pitch and reach predetermined pitch positions corresponding to a given load. In this manner, the device 20 adjusts to maintain a substantially constant torque on the fluid medium.

To reverse the direction of force applied by the device 20, or alter its magnitude, structure is provided as hereinafter described to change the pitch of the control blades 32 from a remote location while the device 20 is operating. This enables, for example, operation of the device 20 with the blades 30 and 32 configured to transmit forces in either axial direction and at selected intermediate configurations to transmit forces of decreasing magnitude, including a substantially non-force transmitting or neutral configuration. Changing the pitch of the control blades 32 is accomplished independently of the load imposed on the device 20 so that the device 20 continues to operate in a self-adjusting manner regardless of the direction or magnitude of the force transmitted.

Referring now in particular to FIGS. 1 through 5, the hub assembly 22 includes a generally cylindrical base portion 34 having a substantially planar front face 36 preferably disposed in a plane that is perpendicular to the hub axis. The outer diameter of the base 34 decreases towards the first end 26 of the hub assembly 22. Disposed adjacent the base 34 and located towards a second axial end 38, the hub assembly 22 includes a generally cylindrical nose portion 40, the outer diameter of which decreases towards the second end 38. The hub assembly 22 is mounted on an elongated pinion 42 extending through a centrally located bore 44 formed in both the base 34 and nose 40 so the bore 44 and elongated pinion 42 both lie on the hub axis.

The drive shaft 24 is configured with a longitudinally extending bore 49 within which the shaft 24 receives the elongated pinion 42. (The shaft 24 is omitted from all the figures except FIGS. 1, 9 and 12 for clarity.) Suitable means (not shown) are provided for attaching the drive shaft 24 to the base 34 of the hub assembly 22 so that the hub assembly 22 rotates with the drive shaft 24.

Figure 1:
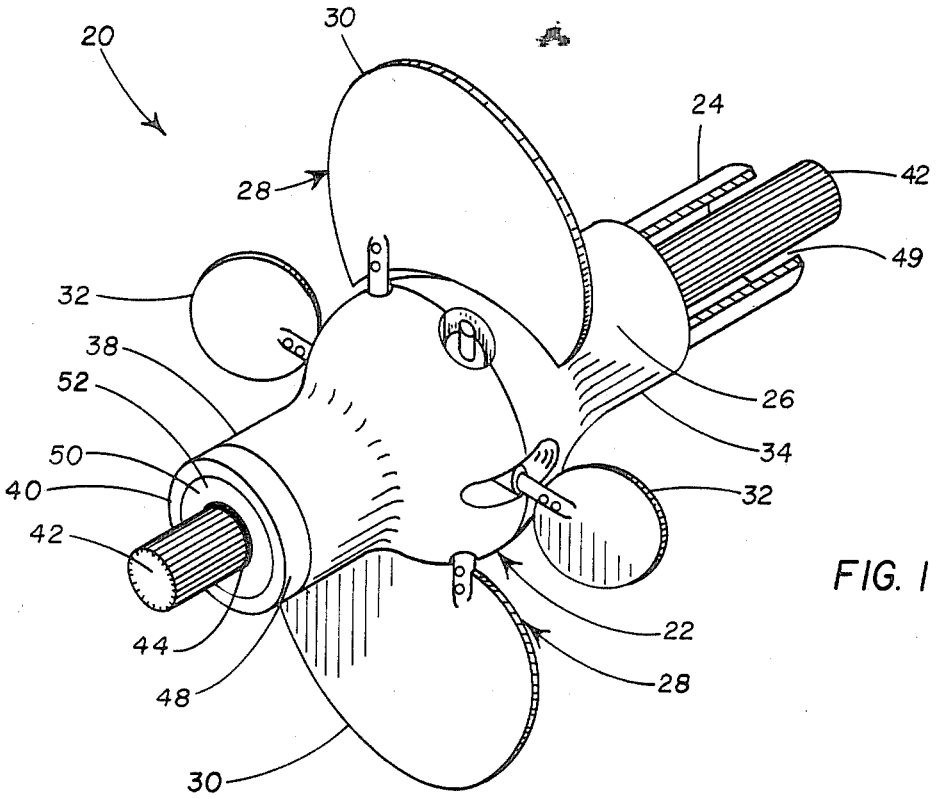
FIG. 1 is a perspective view of a self-adjusting propeller device illustrating features of a preferred embodiment of the present invention including a hub assembly and opposed pairs of thrust and control blade assemblies mounted on the hub assembly for rotation about a hub axis.
Figure 3:
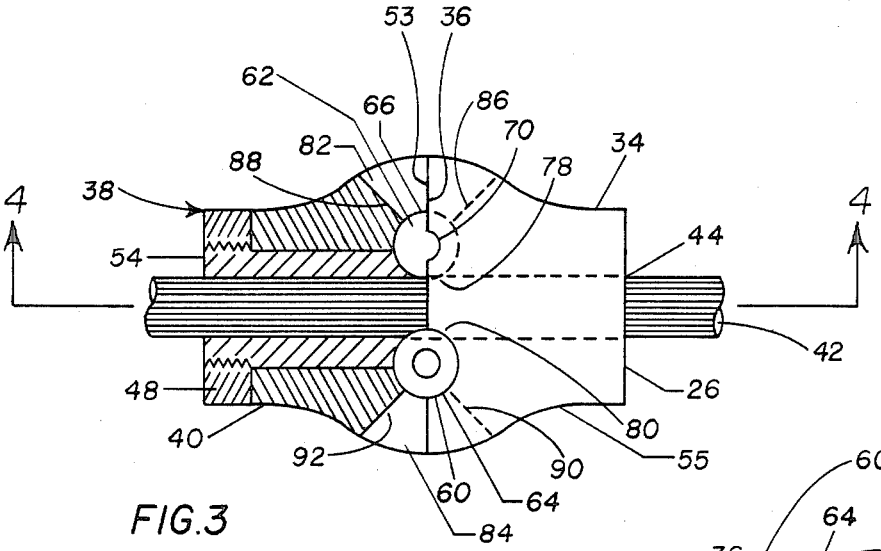
FIG. 3 is a left side view, partially in section, of a base portion and a nose portion of the hub assembly shown in FIG. 1.

An integrally-formed mount 50 of the base 34 projects from the face 36 and is disposed with its longitudinal axis on axis with the hub axis. The mount 50 terminates forwardly of the face 36 at a front planar end 52 and carries the nose portion 40 of the hub assembly 22. The diameter of the nose 40 decreases from a back face 53 to a front planar end 54 and is proportioned so that its front planar end 54 is recessed from the front planar end 52 of the mount 50. A nut 48 is threadably fitted about the mount 50 which contacts the front planar end 54 of the nose 40 to secure the nose 40 to the base 34. The back face 53 has substantially the same diameter as the face 36 of the base 34 as shown in FIGS. 1 and 3. The outer surfaces of the adjacent portions of the base and nose portions 34 and 40 are spherical in configuration with each constituting a hemispherical surface extending back from the respective faces 36 and 53 thereof. When positioned with the faces 36 and 53 in contact as shown in FIG. 3, a generally spherical surface formation 55 of the hub assembly 22 is defined with the center of curvature of the formation 55 lying on the hub axis.

Figure 2:
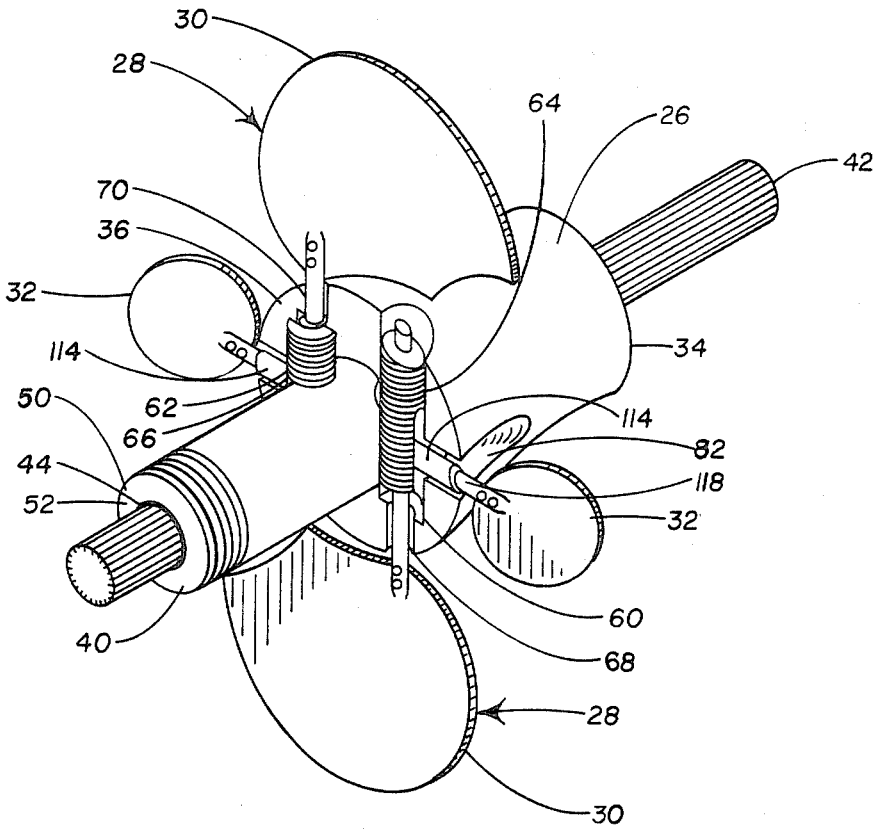
FIG. 2 is a perspective view of the device shown in FIG. 1 with a portion of the hub assembly broken away to show one manner in which the thrust and control blade assemblies may be mounted on the hub.
Figure 4:
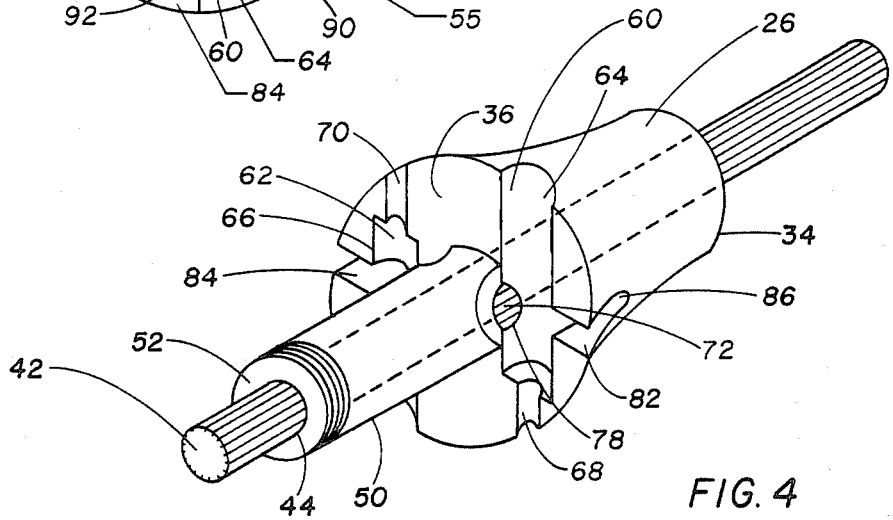
FIG. 4 is a perspective view of the hub assembly shown in FIG. 3 with the nose portion removed.

As shown in FIGS. 2 through 4 and for reasons explained below, both faces 36 and 53 of the base and nose 34 and 40 are configured with matching surfaces so that when the nose 40 is finally positioned on the mount 50 the faces 36 and 53 will be in contact and there will be defined at their intersecting surfaces a pair of substantially parallel bores 60 and 62 extending through the hub assembly 22 substantially perpendicular to the hub axis. Equal areas of the bores 60 and 62 lie in the base and nose portions 34 and 40.

Figure 5:
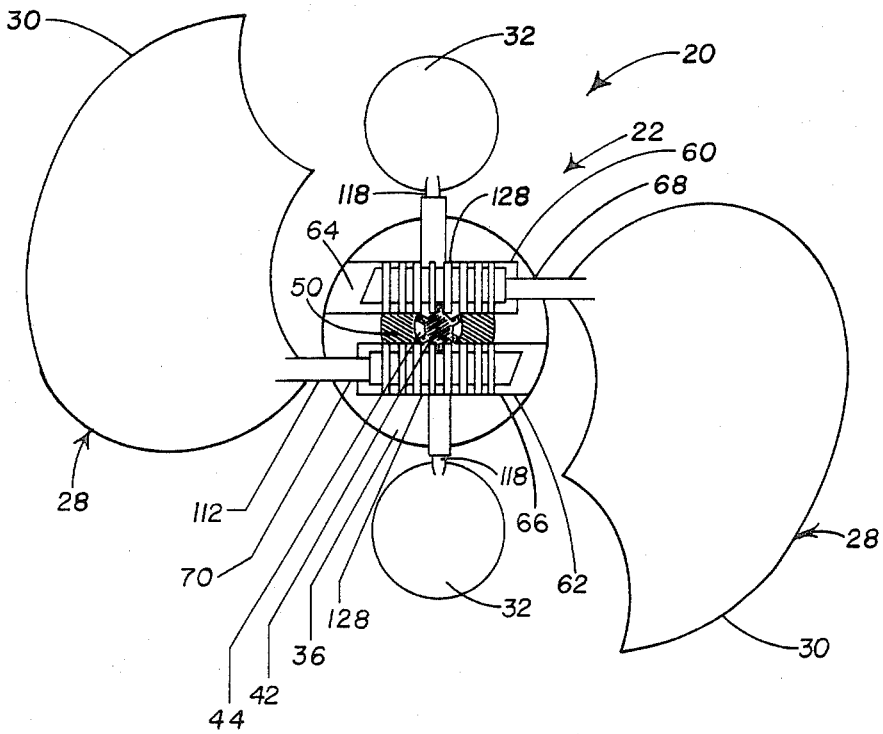
FIG. 5 is an end view of the device shown in FIG. 2, partially in section, further illustrating the manner of mounting the thrust and control blade assemblies on the hub assembly, the connection between the thrust and control blade assemblies, and an elongated pinion extending through the hub assembly and lying on the hub axis.

The bores 60 and 62 are offset from the hub axis by substantially the same distance and include portions of larger diameter 64 and 66 and portions of smaller diameter 68 and 70, respectively. The bores 60 and 62 are of reverse configuration so that the portions of larger diameter 64 and 66 open to opposite sides of the hub assembly 22 as shown in FIG. 5.

At the approximate center of the bores 60 and 62 the larger diameter portions 64 and 66 have openings 72 and 74, respectively, communicating with the central bore 44 of the hub assembly 22. (Only the opening 72 in bore 60 is visible in FIG. 4). The central bore 44 is configured together with the larger diameter portions 64 to 66 so that a part of the areas defined by each of the portions 64 and 66 intersects with the area defined by the central bore 44 to form small, diametrically opposed, saddle-shaped areas of intersection 78 and 80 therebetween.

Elliptical, wedge-shaped recesses 82 and 84 are formed in the hub assembly 22 with their areas divided substantially equally between the base 34 and nose 40 as shown in FIG. 3. In the embodiment depicted, the recesses 82 and 84 are diametrically opposed in the hub assembly 22 and are formed on an axis which intersects with and is substantially perpendicular to the hub axis. The recesses 82 and 84 are of substantially equal proportions with their major cross-sectional axes extending substantially parallel to the hub axis. Radially inwardly converging rounded shoulders 86 and 88 of the recess 82, and 90 and 92 of the recess 84, lie at their respective opposite longitudinal ends.

A part of the surface of the elongated pinion 42 extends into the openings 72 and 74 in the bores 60 and 62 and fills the saddle-shaped areas of intersection 78 and 80 between the bores 60 and 62 and central bore 44. As will be described, this makes the toothed surface of the pinion 42 available for meshingly engaging other apparatus disposed in the bores 60 and 62 to effect a change in the pitch of the control blades 32. If desired, the pinion 42 may be a predominantly smooth-surfaced shaft with teeth on its surface only in the area adjacent the openings 72 and 74.

Means are provided for adjustably coupling the elongated pinion 42 with the power shaft 24 so that the two rotate together on the hub axis but may be angularly displaced one with respect to the other. This enables rotation of the elongated pinion 42 in the hub assembly 22 so that the part of the pinion 42 intruding bores 60 and 62 may impart movement to apparatus contained therein.

A suitable means for accomplishing the above-described adjustable coupling is illustrated in FIGS. 14 through 17 and includes a yoke 96 connected to a shift handle (not shown) and having arcuate fork members 98 and 100. Drive shaft 24 and elongated pinion 42 are concentrically disposed between forks 98 and 100 and mounted therein by a ball bearing 102 interposed between the outer surface of the drive shaft 24 in the forks 98 and 100. A pin 104 extends cross-wise through the center of both shafts 24 and 42 and is fixedly connected at its opposite ends to the inner race of bearing 102.

Figure 15:
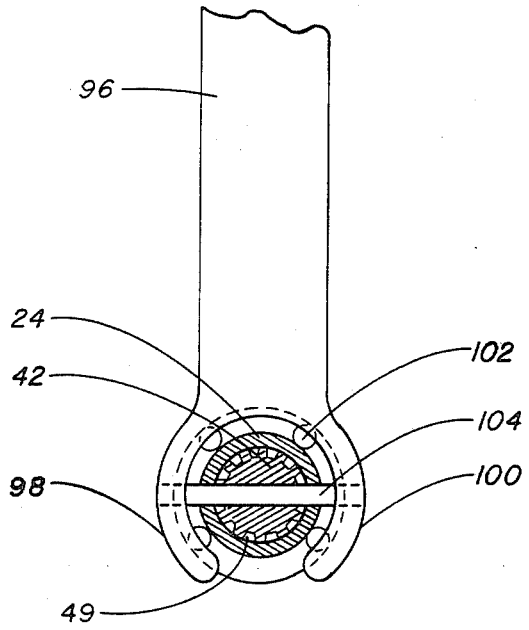
FIG. 15 is an end view of the shifting assembly shown in FIG. 14.

The pin 104 is received in the elongated pinion 42 through a bore 106 viewed from the side in FIG. 17 and from the end in the partial cross-section view of FIG. 15. The pin 104 is received in the drive shaft 24 by means of diametrically opposed slots 108 and 110 formed in the wall of the shaft 24. Slots 108 and 110 extend generally longitudinally of the drive shaft 24 and as shown in FIG. 16 are spirally disposed in relation to the longitudinal axis of the shaft 24.

To effect relative angular displacement of the drive shaft 24 and elongated pinion 42, the yoke 96 is moved longitudinally. The inner race of roller bearing 102 slides on the surface of drive shaft 24 carrying the pin 104 longitudinally through bore 106 of elongated pinion 42 and slots 108 and 110 of drive shaft 24. Since slots 108 and 110 are spiraled, drive shaft 24 is angularly displaced in relation to elongated pinion 42. As a result, elongated pinion 42 turns in bores 60 and 62 of the hub assembly 22 by an amount corresponding to the amount of angular displacement. In addition, the pin 104 through slot 106 causes the elongated pinion 42 to undergo longitudinal translational movement. Since the teeth extend along the surface of the elongated pinion, meshing engagement with the pitch-changing apparatus is maintained. If desired, bore 105 can be elongated into a slot so that pin 104 would move in the slot rather than to impart translational movement to the elongated pinion 42.

Referring now to FIGS. 5 through 8, a preferred means for interconnecting the thrust and control blades 30 and 32 of the assemblies 28 includes elongate thrust and control blade stems 112 and 114. The stems 112 and 114 are fixedly connected together at substantially right angles and are proportioned to be received in the smaller diameter portions 68 and 70 of bores 60 and 62 and in recesses 82 and 84, respectively. As will be described, the manner in which the stems 112 and 114 are mounted in the hub assembly 22 provides for rotation of the thrust and control blades 30 and 32 about the axes of the thrust blade stems 112. As a result, the thrust blades 30 pivot at a changing pitch in relation to the hub axis while the control blades 32 do so at a generally constant pitch.

In order that the pitch of the control blades 32 may be varied, the same are preferably rotatably mounted on stems 114 for rotation about the axis of the stems 114. To accomplish this, the stems 114 are provided with bores 116 extending longitudinally through their centers and receive pivot pins 118, the outer ends of which are fixedly connected to the base portions of control blades 32. The pins 118 are provided on their inner ends with pinions 120 which reside in circular recesses 122 formed at junctions 124 between stems 112 and 114. The centers of circular recesses 122 are preferably aligned with the axis of rotation of the pins 118 in the stems 114.

The junctions 124 are received in inner passageways 126 of circular racks 128 disposed in the large diameter portions 64 and 66 of bores 60 and 62. The outer diameter of circular racks 128 is about, but slightly less than, that of the portions 64 and 66 so that the racks 128 will be free to slide longitudinally in the bores 60 and 62. The inner passageways 126 extend longitudinally through circular racks 128 and are basically cylindrical in configuration with a diameter slightly greater than that of the thrust blade stems 112.

Slots 130 are provided at the ends of the circular racks 128 to form cut-outs extending longitudinally inwardly by a predetermined amount sufficient to enable sliding movement of circular racks 128 in relation to the thrust blade stems 112 residing in the passageways 126 and the control blade stems 114 which extend out of the slots 130. Consistently with the reverse configuration of the bores 60 and 62, circular racks 128 are disposed in the larger diameter portions 64 and 66 thereof with the slots 130 extending out in opposite directions. As viewed in FIGS. 5 and 7, for example, the slot 130 of circular rack 128 in bore 60 extends from the right into the rack 128 and the rack 128 is turned so that slot 130 is at the top. As viewed in FIGS. 5 and 6, the slot 130 of circular rack 128 in bore 62 extends from the left into the rack 128 which is turned so that the slot 130 is at the bottom.

The width of slots 130 is just slightly greater than the diameter of the control blade stems 114. Thus, when the control blade stems 114 pivot about the axes of the thrust blade stems 112 in the recesses 82 and 84, a corresponding rotation of the circular racks 128 occurs in bores 60 and 62 due to engagement of the stems 114 with the walls of the slots 130.

Figure 8:
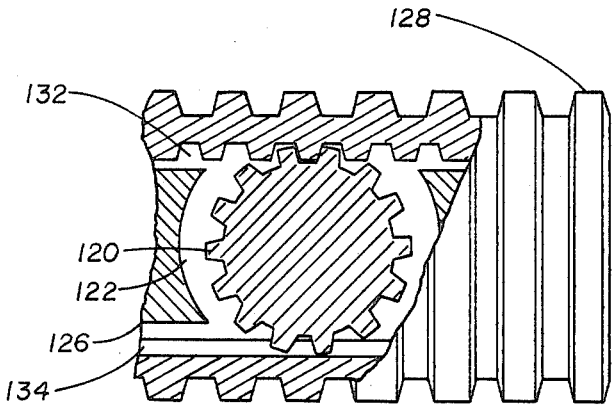
FIG. 8 is a view along line 8—8 of the device as shown in FIG. 6.

Located on the inside of circular racks 128 in the walls of passageways 126 are rack formations 132 best seen in the partial cross-sectional view of the circular rack 128 shown in FIG. 8. The rack formations 132 extend parallel to the axes of the circular racks 128 and generally along their entire length. They are also circumferentially spaced about 90 degrees from the slots 130 so that they project substantially in the direction of the hub axis when the circular racks 128 are oriented with the slots 130 facing up and down as described with the control blade stems 114 extending therethrough.

On the opposite side of passageways 126 from rack formations 132, that is, circumferentially spaced therefrom about 180° are groove-like recesses 134 extending generally along the length of the passageways 126. The distance across the passageways 126 between the recesses 134 and the rack formations 132 is slightly greater than the outermost circumferential dimension of the pinions 120 as shown in FIG. 8.

The respective teeth on pinions 120 and in rack formations 132 are configured to mesh together. Consequently, when thrust blade stems 112 are inserted into passageways 126 of circular racks 128 with control stems 114 extending through slots 130, the pinions 120 are meshingly received into the rack formations 132 on one side of the passageways 126 and are supported in the recesses 134 on the other side.

Figure 6:
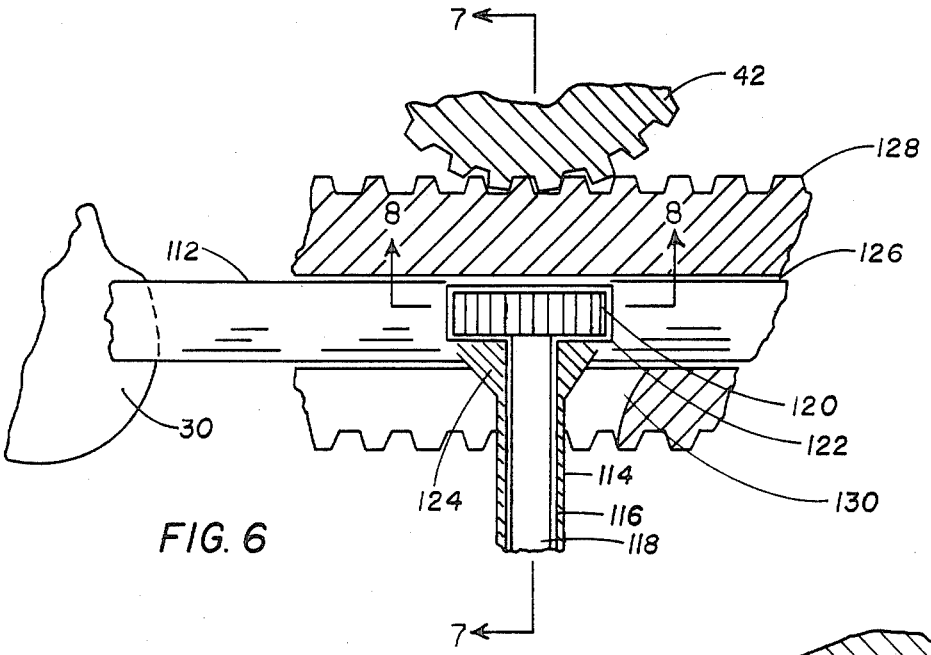
FIG. 6 is a fragmentary end view of the device illustrating features of the invention which enable changing the pitch of the control blades.
Figure 7:
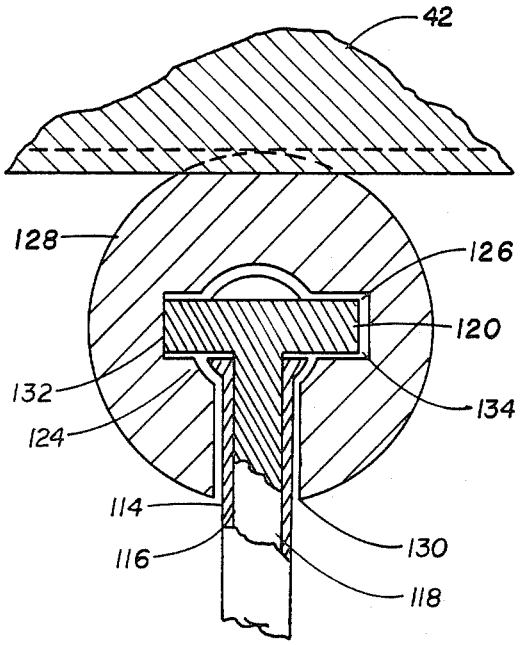
FIG. 7 is a view along line 7—7 of the device as shown in FIG. 6.

The outer teeth on the circular racks 128 are configured to mesh with the teeth on the elongated pinion 42 as best seen in FIGS. 5 and 6. As a result, rotation of the elongated pinion 42 causes translational movement of the circular racks 128 in the larger diameter portions 64 and 66 of bores 60 and 62.

Translational movement of circular racks 128 in bores 60 and 62 causes the pitch of the control blades 32 to change by an amount and in a direction corresponding to the amount and direction in which the circular racks 128 are moved by the elongated pinion 42. A change in the pitch of the control blades 32 occurs since the stems 114 thereof are restrained against movement longitudinally of the bores 60 and 62 by the side walls of the recesses 82 and 84. The stems 114 therefore remain stationary in relation to the racks 128. However, the pinions 122 that are connected to the blades 32 by the pivot pins 118 are rotated in the stems 114 by virtue of their engagement with rack formations 132 located on the inside of the circular racks 128. Thus, the control blades 32 are rotated as the circular racks 128 are translated back and forth in the bores 60 and 62 by the elongated pinion 42.

A change in the pitch of the thrust blades 30 occurs when the assemblies 28 are rotated about the axis of the thrust blade stems 112 carried in the passageways 126 of the circular racks 128. When this occurs, the pitch of the control blades 32 will remain constant unless, of course, elongated pinion 42 is rotated simultaneously with rotation of the assemblies 28 about the axes of the stems 112. The degree to which the assemblies 28 are able to pivot about the axes of the stems 112 is determined by the angle between the shoulders 86 and 88 of the recess 82, and between the shoulders 90 and 92 of the recess 84 as shown in FIG. 3. Preferably, both these angles are the same and may be, for example, about 90°. Since the recesses 82 and 84 are preferably substantially symmetrically disposed about the line of intersection between the base 34 and nose 40, movement of the control blade stems 114 about the axes of the thrust blade stems 112 carries the control blades 32 from a position on one axial side of the hub assembly 22 to the other axial side of the hub assembly 22. Similarly, the thrust blades 30 are mounted on the stems 112 so that they extend substantially in the direction of the control blades 32 so that movement of the control blades 32 between opposed axial dispositions in relation to the hub assembly 22 also changes the pitch of the thrust blades 30 between pitch positions imparting forces predominantly only in one axial direction and positions imparting forces predominantly only in the other axial direction. Also, when the control blade stems 114 are centrally located in the recesses 82 and 84 so that they are substantially perpendicular to the hub axis, the thrust blades 30 will be in a substantially non-axial force transmitting or neutral configuration.

Preferably, the device 20 is configured so that the circular racks 128 are located in the approximate center of the larger portions 64 and 66 of bores 60 and 62 when the blades 30 and 32 are in the neutral configuration. Furthermore, sufficient room is left in portions 64 and 66 to enable back and forth movement of the racks 128 therein as may be required to effect the desired change in pitch of the control blades 32. For example, as viewed in FIG. 5, the relevant proportions of the device 20 provide that clockwise rotation of the elongated pinion 42 relative to the hub assembly 22 moves rack 128 in bore 60 to the right in portion 64 and moves rack 128 in the bore 62 to the left in portion 66. Both movements of the racks 128 should be sufficient to cause the control blades 32 to assume pitch positions which result in the thrust blades 30 being disposed to transmit forces to the fluid medium predominantly in one axial direction. Counterclockwise movement of the splined shaft 42 causes movement of the circular racks 128 to the left and right in bores 60 and 62 reducing the pitch of the control blades 32 so that the device 20 operates in a self-adjusting manner at a smaller torque until the racks 128 again are positioned in the approximate center of portions 64 and 66 whereof the device 20 is in the neutral mode. Of course, continued counterclockwise movement of splined shaft 42 brings the control blades 32 into pitch positions causing the thrust blades 30 to begin transmitting forces in the other axial direction.

In operation, the device 20 is located in a fluid medium for the purpose of transmitting forces thereby. Rotation of the device 20 is imparted through the drive shaft 24 by suitable means such as an electric motor or combustion engine. Alternately, the device 20 may be rotated by the action of a fluid moving in relation to the device. At any given pitch position of the control blades 32, the elongated pinion 42 and drive shaft 24 rotate together by virtue of the pin 104 extending through both as described above as shown in FIGS. 14 and 15. For the purposes of illustration, the following describes operation of the device 20 when drive shaft 24 is driven to rotate the propeller device 20.

Figure 9:
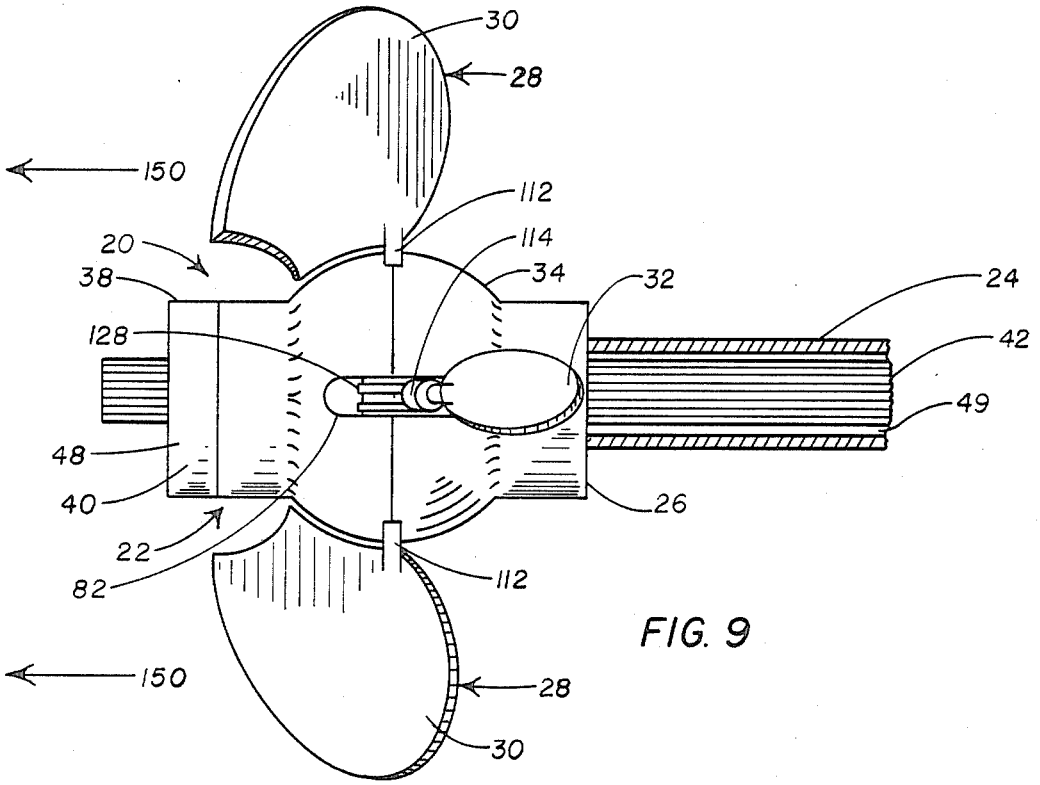
FIG. 9 is a right side view of the device as shown in FIG. 1 with the thrust and control blade assemblies configured to transmit forces predominantly in one axial direction.
Figure 10:
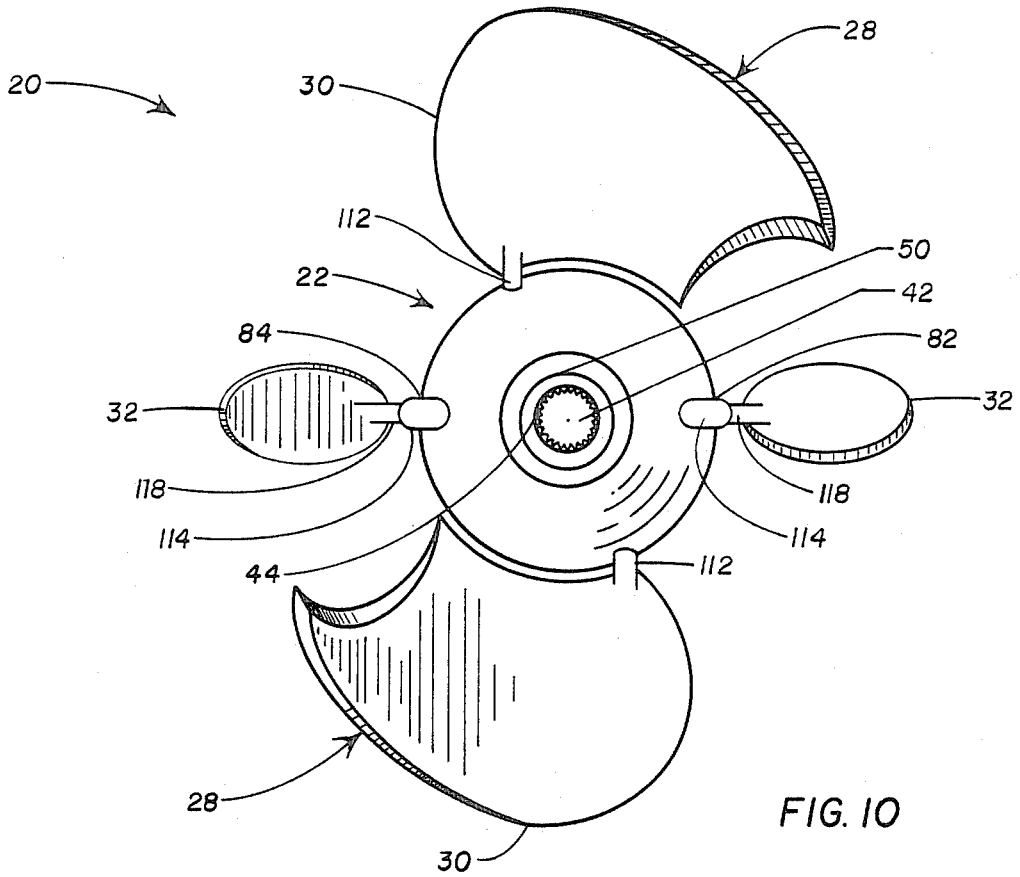
FIG. 10 is an end view of the device configured as shown in FIG. 9 illustrating the position of the blades from the end of the device toward which forces are transmitted.

FIGS.9 and 10 represent one orientation of the thrust and control blades 30 and 32 when the device is configured to impart forces on the fluid to the left as viewed in FIG. 9 producing a flow of the fluid generally in the direction of arrows 150 when the device 20 is rotating counterclockwise as viewed in FIG. 10. The pitch of the thrust and control blades 30 and 32 is such that force is applied to the fluid from the sides of the blades adjacent to the nose 40. With the device 20 spinning in the fluid medium as configured in FIGS. 9 and 10, a change in the load causes the thrust and control blades 30 and 32 to pivot in recesses 82 and 84 about the axis of the thrust blade stems 112 as described. When the load increases, the pitch of the thrust blades 30 decreases and the control blades 32 move radially outwardly of the hub axis to a more perpendicular disposition of the control blade stems 114 in relation to the hub axis. The reverse occurs when the load decreases. In either case, however, the pitch of the control blades 32 remains generally constant. As a result, the device 20 applies a substantially constant torque on the fluid medium regardless of the load imposed.

The amount of torque generated by the device 20 on the fluid medium can be adjusted as desired through a change in the pitch of the control blades 32 to larger or smaller pitch orientations by longitudinally moving the yoke 96 to cause angular displacement of the drive shaft 24 in relation to the elongated pinion 42. For example, displacing the elongated pinion 42 in relation to the drive shaft 24 to obtain a greater pitch of the control blades 32 causes the device 20 to develop a larger torque since the balance achieved between the thrust and control blades 30 and 32 occurs with the thrust blades 30 at a greater pitch. Decreasing the torque developed by the device 20 is accomplished by lessening the pitch of the control blades 32.

Figure 11:
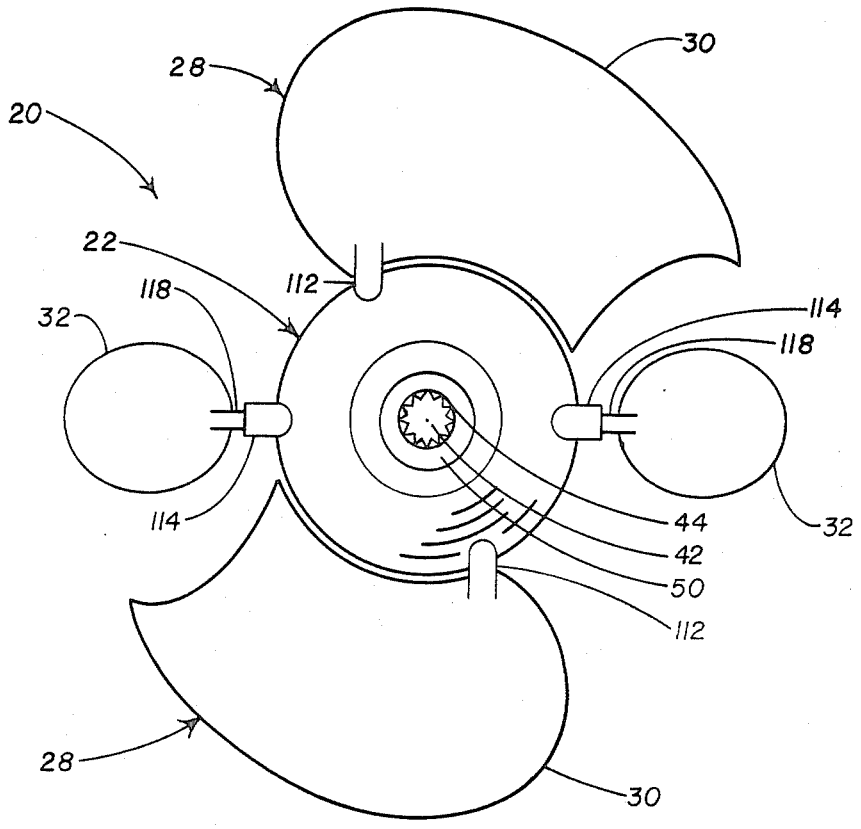
FIG. 11 is an end view of the device with the blades in a neutral or substantially non-force-transmitting configuration.

The device 20 generates minimum torque and therefore transmits minimum forces when the above-described mechanism for changing the pitch of the control blades 32 is employed to set the control blades 32 at a zero or minimum pitch. This configuration of the control blades 32 is shown in FIG. 11. With the control blades 32 in a zero pitch configuration, the thrust blades 30 assume a similar configuration and do not transmit forces in either axial direction. This may be considered, for example, the neutral mode of the device 20 and, as described, preferably occurs when the circular racks 128 are approximately midway between the ends of the larger diameter portions 64 and 66 of bores 60 and 62. Similarly, in the neutral mode of the device 20, pin 104 should be located approximately midway between the ends of slots 106 of elongated pinion 42 and about midway between the ends of slots 108 and 110 of drive shaft 24.

Figure 12:
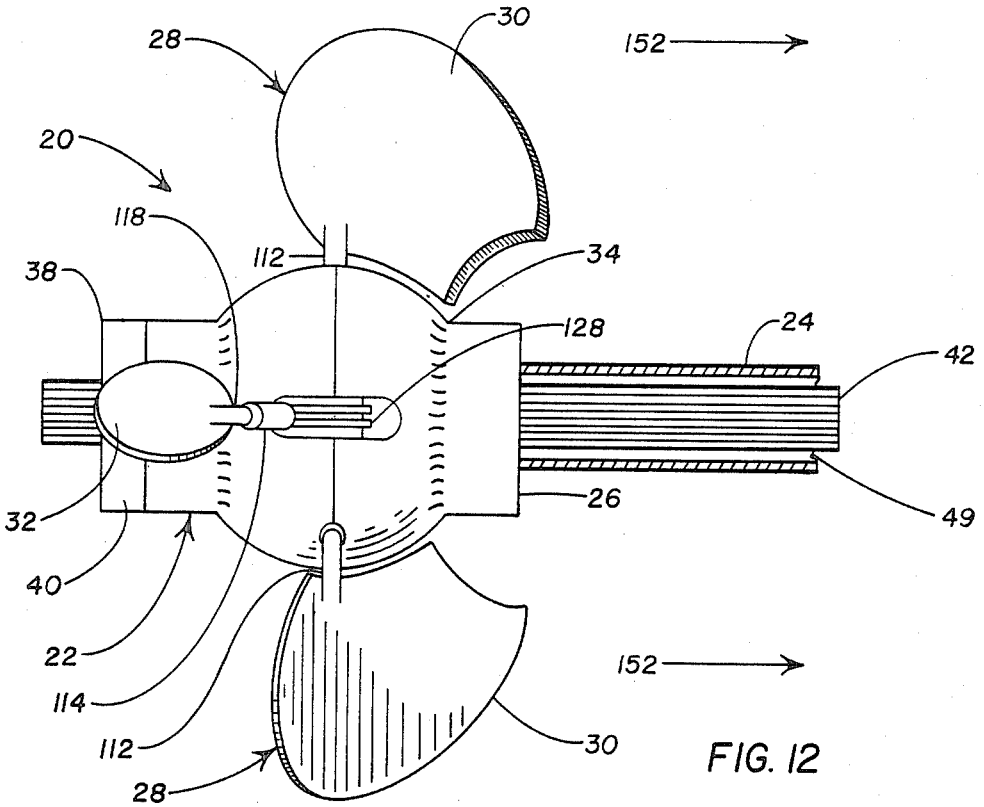
FIG. 12 is a right side view of the device as shown in FIG. 1 with the thrust and control blade assemblies configured to transmit forces predominantly in an axial direction opposite that of the assemblies configures as shown in FIG. 9.

Forces may be transmitted to the fluid medium to the right of the device 20 as shown in FIG. 12 generally in the direction of arrows 152 by changing the pitch of control blades 32 to a position exemplified by the positions shown in FIGS. 12 and 13. This is also accomplished by angularly displacing the elongated pinion 42 in relation to the drive shaft 24 through longitudinal movement of the yoke 96. For example, with the device 20 rotating counter clockwise as shown in FIG. 13, the pitch of the control blades 32 is set so that the portions of the blades 32 facing their direction of movement are acted upon by the fluid medium to cause the control blades 32 to pivot in the direction of the nose 40 of the device 20 as shown in FIG. 12. The thrust blades 30 are correspondingly pivoted about the axes of the thrust blade stems 112 and assume pitch positions causing the abovedescribed fluid movement in the direction of arrows 152. From thereafter, the device 20 operates in a self-adjusting manner to develop a substantially constant torque as described through the balancing arrangement of the thrust and control blade assemblies 28. Again, as described, the magnitude of the torque developed by the device 20, even when moving the fluid in the direction of arrows 152, can be adjusted by changing the pitch of the control blades 32.

The above-described operation of the device 20 to transmit forces in either axial direction and at selected magnitudes is accomplished very conveniently and remotely of the environment of the device 20 through the use of a simple and effective mechanism for changing the pitch of the control blades 32. Moreover, adjustment of the pitch 32 to enable these advantageous modes of operation does not in any way interfere with the normal self-adjusting capabilities of the device 20. Thus, the desired torque is selected by setting the pitch of the control blades 32 and the device 20 operates thereafter to develop approximately the same torque regardless of the load imposed on the device 20. The device 20 operates similarly in, for example, a turbine where flowing fluid imparts rotation to the device. The device is capable of being rotated in the same direction by fluid flowing in either axial direction.

The propeller device 20 is consequently suitable for a wide variety of applications including, for example, continuously variable transmissions where forward, neutral, reverse, modes are desired. In such devices, a propeller according to the invention can be coupled with, for example, either an adjacent or remote fixed pitch turbine. The output can be continuously variable in forward or reverse directions at selected torque settings.

Although a particular embodiment of the invention has been described in the foregoing detailed description, it will be understood that the device is capable of numerous rearrangements, substitutions and modifications of parts without departing from the scope of the invention as set forth in the claims below.

What is claimed:

1. A self-adjusting propeller device for transmitting forces to and from a fluid, comprising:

a thrust blade having a thrust blade area;

a control blade having a control blade area that is less than the blade area of said thrust blade;

a hub supporting said thrust and control blades for rotation in the fluid about a hub axis so that said thrust and control blades transmit forces to the fluid as they are rotated about the hub axis with the force transmitted being proportional to the pitch of each ;

means for interconnecting said thrust and control blades so that in response to a changing load on the device, said thrust and control blades move in relation to said hub axis with said thrust blade moving in relation to said hub axis at a changing pitch with the change in pitch of said thrust blade being proportional to the change in the load; and means for changing the pitch of said control blade to selected pitch settings.

2. The device of claim 1 wherein said means for interconnecting is configured to maintain said control blade at a generally constant pitch at a selected pitch setting as said control blade moves in relation to said axis in response to a changing load.

3. The device of claim 1, wherein the pitch changing means is operable to change the pitch of said control blade while said hub is rotating about said hub axis and the device is transmitting force.

4. The device of claim 1, wherein said pitch changing means is operable to hold and move said control blade at and between control blade pitch settings inclusive of and intermediate first and second control blade pitch settings, said interconnecting means being configured so that said thrust and control blades transmit forces to the fluid substantially only in one axial direction when said control blade is in said first control blade setting and substantially only in the other axial direction when said control blade is in said second control blade setting, and so that said thrust and control blades transmit forces of decreasing magnitude as said control blade is moved away from either said first or said second control blade pitch settings in the direction of a third control blade pitch setting intermediate said first and second settings at which said thrust blade and control blades transmit minimum forces to the fluid.

5. The device of claim 1, wherein said interconnecting means is configured to support said thrust and control blades in a fixed angular circumferential relationship about said hub axis and said hub is configured to pivotally receive said interconnecting means for pivotal motion thereof about a thrust blade axis substantially perpendicular to said hub axis so that in response to a changing load on the device, said control blade pivots in relation to said hub axis about said thrust blade axis with a substantially constant pitch and said thrust blade pivots in relation to said hub axis about said thrust blade axis with a varying pitch.

6. The device of claim 4, wherein said pitch changing means is configured to change the pitch of said control blade by rotating said control blade about a control blade axis that intersects both said thrust blade axis and said hub axis and is substantially perpendicular to said blade axis.

7. The device of claim 1, further comprising rotating drive means connected to said hub for rotatably driving said hub in the fluid about said hub axis, said pitch changing means comprising:

turning means rotatably coupled with said drive means so that said turning means and drive means rotate together about said hub axis;

displacement means for angularly displacing said turning means in relation to said drive means while said drive and turning means are rotating about said hub axis;

connection means for operably connecting said turning means to said control blade so that said turning means is operably connected to said control blade while said drive and turning means are rotating about said hub axis, said connection means being configured together with said turning means so that angular displacement of said turning means in relation to said drive means by said displacement means causes the pitch of said control blade to change by an amount corresponding to the amount of angular displacement of said turning means in relation to said drive means.

8. The device of claim 6, wherein said drive means and turning means comprise:

a drive shaft connected to said hub and having its longitudinal axis on axis with said hub axis;

a bore extending longitudinally through the center of said drive shaft and opening on one end of said drive shaft to communicate with said hub;

a turning shaft disposed in said bore and having one end extending through the opening of said bore on one end of said drive shaft, said hub being configured to rotatably receive said one end of said turning shaft with said turning shaft disposed with its axis on axis with said hub axis; and said turning shaft being connected to said connection means on its end received in said hub.

9. The device of claim 7, wherein said means for interconnecting said thrust and control blades comprises a control blade stem supporting said control blade and a thrust blade stem supporting said thrust blade and being fixedly connected to said control blade stem at a junction so that said control and thrust blade stems extend in a substantially perpendicular relation one with respect to the other from said junction, and said connection means comprises:

a circular rack having a bore in its center configured to slidably receive said junction of said thrust and control blade stems so that said circular rack is movable along its longitudinal axis in relation to said thrust and control blade stems substantially perpendicularly to the direction of said control blade stem and substantially parallel to said thrust blade stem, and so that rotation of said control blade stem about the axis of said circular rack causes a corresponding rotation of both said rack and said thrust blade stems about the axis of said circular rack;

said hub being configured to slidably and rotatably receive said circular rack for sliding and rotating movement on an axis substantially perpendicular to and radially displaced from said hub axis;

a gear formation on said turning shaft meshingly connecting said turning shaft with said circular rack so that rotation of said turning shaft in said hub imparts a sliding movement of said circular rack in said hub along the axis of said circular rack and substantially perpendicular to said hub axis;

means for maintaining said conrol blade stem in a substantially fixed radial position in said hub so that said control and thrust blades and their associated stems are restrained from movement with said circular rack when sliding movement of said circular rack is imparted through rotation of said turning shaft;

said maintaining means being configured to allow said control blade stem to pivot about the axis of said circular rack and so that the axis of said control blade stem intersects the axis of said circular rack and said hub axis;

said control blade stem comprising:

a through opening extending through the approximate center of said control blade stem and along the longitudinal axis thereof so that one end of said through opening opens at said junction;

a control blade pivot pin rotatably disposed in said through opening and connected at one of its ends to said control blade; and a pinion connected to the other end of said pivot pin adjacent said junction so that said pinion is received in said bore of said circular rack; and a rack formation in said bore of said circular rack configured to mesh with said pinion of said control blade stem so that sliding movement of said circular rack in said hub and in relation to said control blade stem causes said rack formation to engage said pinion and impart rotation thereto which in turn causes said pivot pin to rotate in said control blade stem effecting a rotation of said control blade and thus a change in the pitch thereof.

* * * * *

UNITED STATES PATENT AND TRADEMARK OFFICE

CERTIFICATE OF CORRECTION

PATENT NO. : 4,693,671

DATED : September 15, 1987

INVENTOR(S) : Harold C. Thornton, Jr., and Clifton W. Hall

It is certified that error appears in the above-identified patent and that said Letters Patent is hereby corrected as shown below:

In the title, insert -- and -- after "Reversible."

Column 5, line 50, change "105" to -- 106 --.

Column 12, line 23, change "conrol" to -- control --.

Signed and Sealed this

Twenty-ninth Day of December, 1987

*Attest:*

DONALD J. QUIGG

*Attesting Officer*

*Commissioner of Patents and Trademarks*